US010224615B2

(12) United States Patent
Wu et al.

(10) Patent No.: US 10,224,615 B2
(45) Date of Patent: Mar. 5, 2019

(54) WIRELESS COMMUNICATION DEVICE AND ANTENNA UNIT THEREOF

(71) Applicant: PEGATRON CORPORATION, Taipei (TW)

(72) Inventors: Chien-Yi Wu, Taipei (TW); Chao-Hsu Wu, Taipei (TW); Yu-Yi Chu, Taipei (TW); Ya-Jyun Li, Taipei (TW); Shih-Keng Huang, Taipei (TW); Ching-Hsiang Ko, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 15/796,869

(22) Filed: Oct. 30, 2017

(65) Prior Publication Data

US 2018/0138582 A1 May 17, 2018

(30) Foreign Application Priority Data

Nov. 15, 2016 (TW) ..... 105137306 A

(51) Int. Cl.
*H01Q 1/24* (2006.01)
*H01Q 13/10* (2006.01)
(Continued)

(52) U.S. Cl.
CPC ..... *H01Q 1/246* (2013.01); *H01Q 1/2291* (2013.01); *H01Q 1/241* (2013.01); *H01Q 1/48* (2013.01);
(Continued)

(58) Field of Classification Search
CPC ..... H01Q 1/2291; H01Q 1/241; H01Q 1/246; H01Q 1/521; H01Q 1/526; H01Q 1/18;
(Continued)

(56) References Cited

U.S. PATENT DOCUMENTS

2010/0103069 A1 4/2010 Wang et al.
2014/0049431 A1* 2/2014 Tai ..... H01Q 1/36 343/700 MS (Continued)

FOREIGN PATENT DOCUMENTS

TW 201505263 A 2/2015
TW I517500 B 1/2016
TW I545837 B 8/2016

*Primary Examiner* — Hoang V Nguyen
(74) *Attorney, Agent, or Firm* — McClure, Qualey & Rodack, LLP

(57) ABSTRACT

A wireless communication device includes a housing and a plurality of antenna units. The antenna units surround a surface of the housing and stand on a system ground. Each of the antenna units includes a first radiation part, a second radiation part and a conductive component. The first radiation part has a signal feed point for receiving a feeding signal. The second radiation part surrounds the first radiation part and has a first side, a second side, a first ground point and a second ground point, wherein the first side is parallel to the system ground while the second side is perpendicular to the system ground. The first side is perpendicular to the second side and shorter than the second side. The conductive component is disposed between the first side and the system ground and connected to the first side and the system ground.

17 Claims, 9 Drawing Sheets

(51) Int. Cl.

| | |
|---|---|
| ***H01Q 1/52*** | (2006.01) |
| ***H01Q 21/06*** | (2006.01) |
| ***H01Q 5/357*** | (2015.01) |
| ***H01Q 1/48*** | (2006.01) |
| ***H01Q 9/42*** | (2006.01) |
| ***H01Q 5/307*** | (2015.01) |
| ***H01Q 1/22*** | (2006.01) |
| ***H01Q 13/16*** | (2006.01) |
| ***H01Q 21/20*** | (2006.01) |
| ***H01Q 5/371*** | (2015.01) |
| ***H01Q 5/378*** | (2015.01) |
| *H01Q 21/00* | (2006.01) |

(52) U.S. Cl.
CPC ..... *H01Q 1/526* (2013.01); *H01Q 5/307* (2015.01); *H01Q 5/357* (2015.01); *H01Q 5/371* (2015.01); *H01Q 5/378* (2015.01); *H01Q 9/42* (2013.01); *H01Q 13/10* (2013.01); *H01Q 13/16* (2013.01); *H01Q 21/064* (2013.01); *H01Q 21/205* (2013.01); *H01Q 1/521* (2013.01); *H01Q 21/0031* (2013.01)

(58) Field of Classification Search
CPC ..... H01Q 5/307; H01Q 5/357; H01Q 5/371; H01Q 5/378; H01Q 9/42; H01Q 13/10; H01Q 13/16; H01Q 21/205; H01Q 21/064; H01Q 21/0031
See application file for complete search history.

(56) References Cited

U.S. PATENT DOCUMENTS

| | | | | |
|---|---|---|---|---|
| 2014/0253398 | A1* | 9/2014 | Hsieh ..... | H01Q 5/328 343/745 |
| 2015/0022402 | A1 | 1/2015 | Gavilan et al. | |
| 2015/0200448 | A1* | 7/2015 | Tsai ..... | H01Q 1/243 343/702 |
| 2016/0380336 | A1 | 12/2016 | Wu et al. | |

* cited by examiner

WIRELESS COMMUNICATION DEVICE AND ANTENNA UNIT THEREOF

CROSS-REFERENCE TO RELATED APPLICATIONS

This application claims the priority benefits of Taiwan Patent Application No. 105137306, filed on Nov. 15, 2016. The entirety of the above-mentioned patent applications are hereby incorporated by references herein and made a part of specification.

BACKGROUND

Field of Invention

The disclosure relates to a wireless communication device and, more particularly, to a wireless communication device capable of accommodating multiple antenna units and the antenna units thereof.

Related Art

As Cloud technology has been developing, Internet of Things (IoT) will become one of the important research interests. Currently, IoT products, such as access points (APs), routers, and Hubs support only certain wireless protocols, such as Bluetooth, Wi-Fi and ZigBee. If it is desired for the IoT products to be equipped with an antenna supporting a low frequency wireless network protocol (e.g. LTE or Z-Wave), how multiple antennas are all deployed in one single wireless communication device might encounter some difficulty due to a larger size of the antenna supporting the low frequency wireless network protocol. In addition, the antenna capable of supporting low frequency usually has its longer side disposed in parallel to a system ground to ensure the ground loop is complete, and thereby the antenna efficiency can be enhanced. However, arranging the multiple antennas with their long sides connected to the system ground inside the single housing not only increases the volume of the housing, also restricts the flexibility of the appearance design for the device.

Therefore, the present invention aims to design an antenna having a short side in parallel to the system ground and supporting low frequency, thereby accommodating more sets of antennas inside the housing of the wireless communication device.

SUMMARY

According to one aspect of the invention, the invention provides a wireless communication device. The wireless communication device includes a housing and a plurality of antenna units. The housing includes a system ground. The antenna units surround the housing and stand on the system ground. Each antenna unit includes a first radiation part, a second radiation part and a conductive component. The first radiation part has a signal feed point. The signal feed point is used for receiving a feeding signal. The second radiation part surrounds the first radiation part and has a first side, a second side, a first ground point and a second ground point. The first side is parallel to the system ground while the second side is perpendicular to the system ground. The first side is perpendicular to the second side and shorter than the second side. The first ground point and the second ground point are individually connected to the system ground. The conductive component is disposed between the first side and the system ground and connected to the first side and the system ground.

According to one aspect of the invention, the invention provides an antenna unit. The antenna unit stands on a system ground of a wireless communication device. The antenna unit includes a first radiation part, a second radiation part and a conductive component. The first radiation part has a signal feed point. The signal feed point is used for receiving a feeding signal. The second radiation part surrounds the first radiation part and has a first side, a second side, a first ground point and a second ground point. The first side is parallel to the system ground while the second side is perpendicular to the system ground. The first ground point and the second ground point are individually connected to the system ground. The conductive component is disposed between the first side and the system ground and connected to the first side and the system ground.

Upon the teachings of the present invention, the antenna unit supporting a low frequency wireless network protocol has its short side coupled to the system ground, which allows multiple antenna units to stand on the system ground. This not only decreases the size of the wireless communication device, also enhance the spatial usage rate of the housing.

These and other features, aspects, and advantages of the present invention will become better understood with regard to the following description, appended claims, and accompanying drawings.

DETAILED DESCRIPTION OF THE EMBODIMENT

The following detailed descriptions are elaborated by embodiments in cooperation with drawings, but the specific embodiments described below are intended for explaining the present invention, not limitations of the present invention. The structural descriptions should not limit the order in which they are performed. Devices that are reassembled from any elements and have equal efficacy are all within the scope of the present disclosure.

In addition, the drawings are only illustrative and not drawn in accordance with their true dimensions. Regarding the "electrically connected" or "electrically coupled" used herein, it may refer to two or more element entities that are physically in an electrical contact or indirectly in an electrical contact.

Figure 1A:
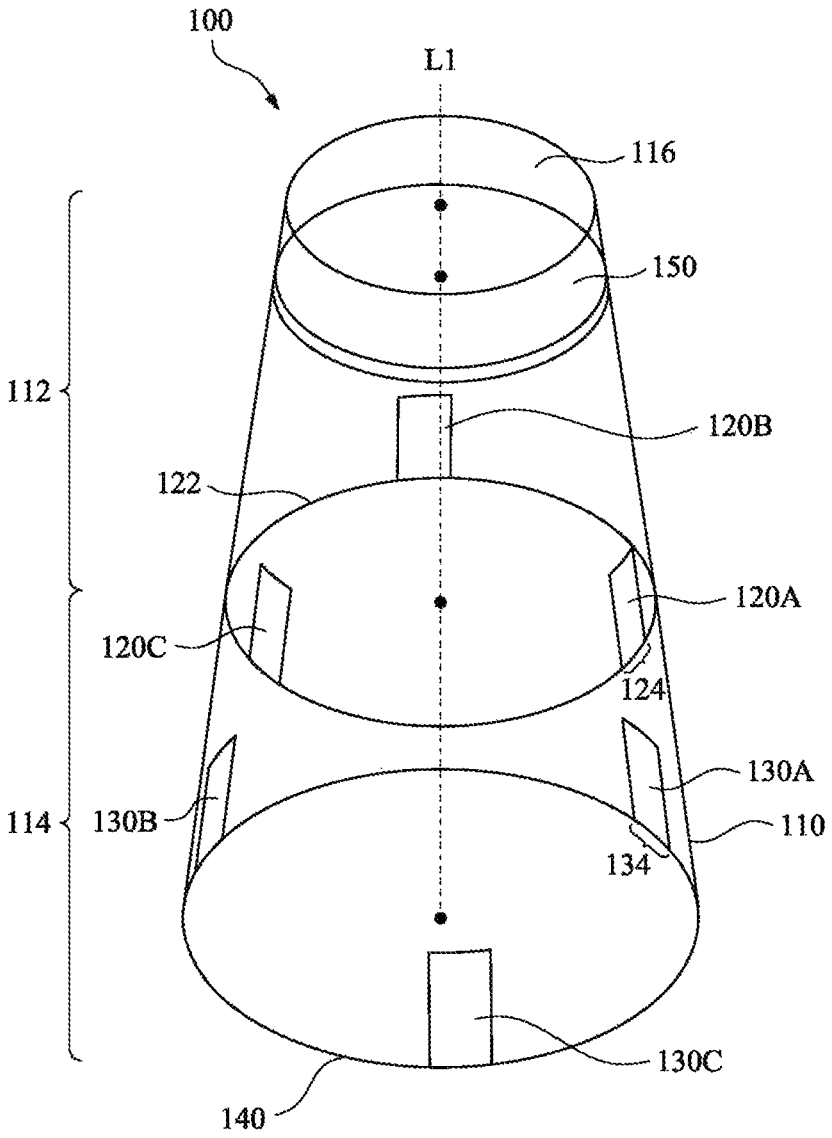
FIG. 1A is a schematic diagram of a wireless communication device according to an embodiment of the present invention.

Please refer to FIG. 1A. FIG. 1A is a schematic diagram of a wireless communication device 100 according to an embodiment of the present invention. The wireless communication device 100 is cylindrical, including, for example, a circular cylinder, a polygonal cylinder or a cylinder in any shape, but not limited herein. In this embodiment, the wireless communication device 100 includes a housing 110. The appearance of the housing 110 is a circular truncated cone. The diameter of the bottom of the circular truncated cone is 130 mm; the diameter of the top of the circular truncated cone is 80 mm; the height of the circular truncated cone is 200 mm. The housing 110 is made of dielectric material, such as plastic. In addition, the inside of the hosing 110 is hollow so that it can accommodate many electrical components, such as a camera lens, a microphone module, and a speaker.

The housing 110 consists of a top surface 116, a system ground 140, and a curved side surface. The curved side surface of the housing 110 includes an upper part 112 and a lower part 114. The upper part 112 and the lower part 114 are divided by a cross section 122. It is understood that the upper part 112 and the lower part 114 may be integratedly formed (one-piece), or the curved side surface may be assembled by two independent parts. The housing 110 includes multiple antenna units 130A, 130B and 130C and multiple antenna modules 120A, 120B and 120C. The antenna modules 120A, 120B and 120C surround the surface of the upper part 112 and the cross section 122; herein, the surface can be referred to as an inner surface or an outer surface. Since the housing 110 is dielectric, there is no impact on the antenna efficiency even if the antenna modules 120A, 120B and 120C are partially or entirely disposed on the inner surface of the upper part 112. In the following descriptions of this disclosure, the antenna modules 120A, 120B and 120C disposed on the outer surface of the upper part 112 are taken for an example.

In one embodiment, the antenna modules 120A, 120B and 120C can be antennas supporting high frequency wireless network protocols, such as a primary Wi-Fi antenna, an auxiliary Wi-Fi antenna and a ZigBee antenna, respectively. The antenna modules 120A, 120B and 12C are individually connected to a wireless transceiver (not shown herein) and the system ground 140 via respective coaxial cables. The antenna modules 120A, 120B and 120C all stand on the cross section 122, like the way the first side 124, the short side, of the antenna module 120A is connected with the cross section 122 in FIG. 1. The antenna modules 120A, 120B and 120C in the upper part are, for example, discretely arranged around the central axis L1 of the housing 110, as shown in FIG. 1B, which illustrates the top view of the wireless communication device 100 according to an embodiment of the present invention.

Figure 1B:
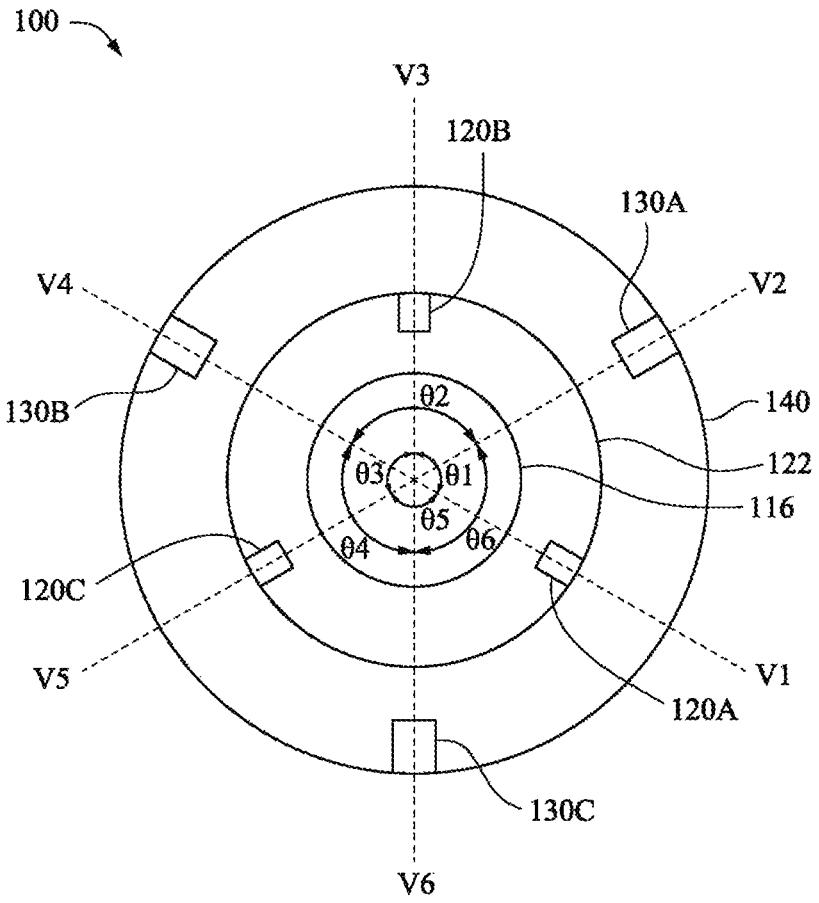
FIGS. 1B~1C are top views of a wireless communication device according to an embodiment of the present invention.
Figure 1C:
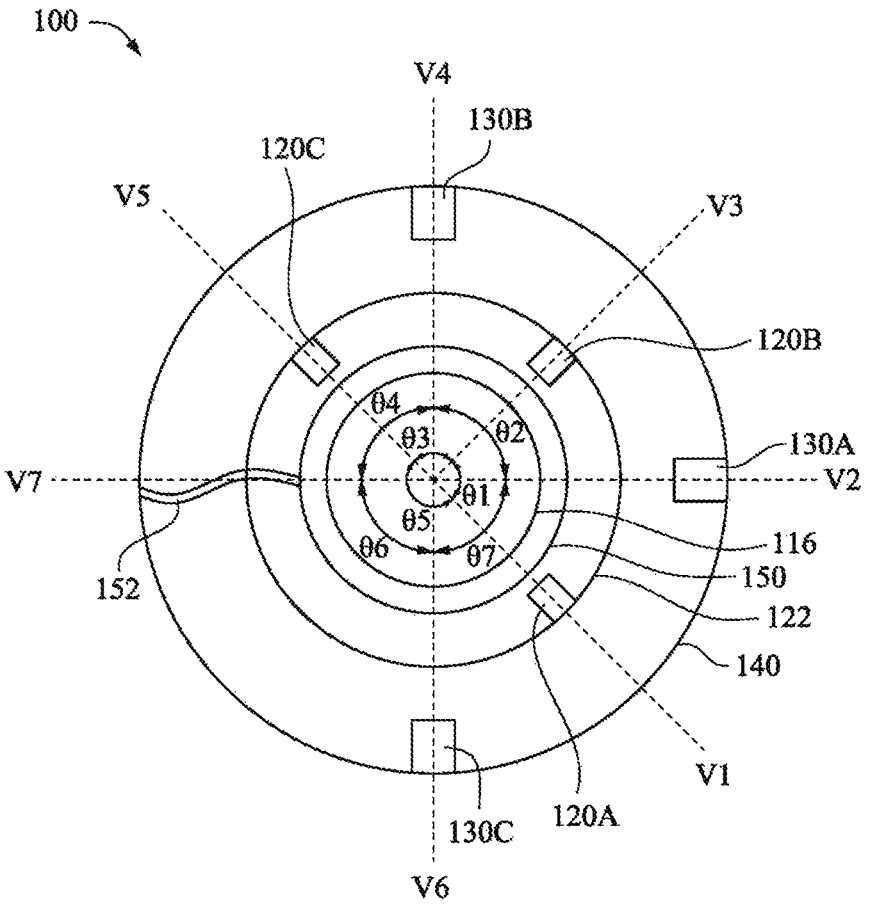

As seen in FIG. 1B, the antenna modules 120A, 120B and 120C are located in different orientations V1, V3 and V5, respectively, on the cross section 122. The abovementioned orientations are referred to as the respective links between each of the antenna modules 120A, 120B and 120C and the central axis L1 of the housing 110. The angle between the orientations V1 and V3 is denoted as θ1; the angle between the orientations V3 and V5 is denoted as θ3; the angle between the orientations V1 and V5 is denoted as θ5. When the antenna modules 120A, 120B and 120C are equiangularly disposed relative to the central axis L1, each of the angles θ1, θ3 and θ5 is 120 degrees. With such arrangement, the antenna modules 120A, 120B and 120C can keep the farthest distance from one another in the upper part 112 of the housing 110 and significantly reduce the mutual interference. Further, the best isolation between one and another among these antennas can be achieved. It is noted that the angles θ1, θ3 and θ5 may be modified according to the practical requirements.

Back to FIG. 1A, the antenna units 130A, 130B and 130C are disposed around the surface of the lower part 114 and stand on the system ground 140. The antenna units 130A, 130B and 130C may be disposed on the inner surface or the outer surface of the lower part 114. In this disclosure of the following descriptions, the antenna units 130A, 130B and 130C disposed on the inner surface or the outer surface of the lower part 114 are taken for an example.

In one embodiment, the antenna units 130A, 130B and 130C are a primary LTE antenna, an auxiliary LTE antenna and a Z-wave antenna, respectively, supporting low frequency wireless network protocols and high frequency wireless network protocols. The antenna units 130A, 130B and 130C are connected to the system ground 140 by the first side 134, the short side, as shown in FIG. 1A. As seen in FIG. 1B, the antenna units 130A, 130B and 130C in the lower part 114 are discretely arranged, for example, around the central axis L1 of the housing 110.

As seen in FIG. 1B, the antenna units 130A, 130B and 130C are located on the system ground in the orientations V2, V4 and V6, respectively. The abovementioned orientations are referred to as the respective links between the central axis L1 and each of the antenna units 130A, 130B and 130C. The angle between the orientations V2 and V4 is denoted as θ2; the angle between the orientations V4 and V6 is denoted as θ4; the angle between the orientations V6 and V2 is denoted as θ6. When the antenna units 130A, 130B and 130C are equianglarly disposed relative to the central axis L1, each of the angles θ2 , θ4 , θ6 is 120 degrees. With such arrangement, the antenna modules 130A, 130B and 130C can keep the farthest distance from one another in the lower part 114 of the housing 110 and significantly reduce the mutual interference. Further, the best isolation between one and another among these antennas can be achieved. It is noted that the angles θ2, θ4 and θ6 may be modified according to the practical requirements.

Besides, in order to achieve the best isolation between the antenna modules 120A, 120B and 120C in the upper part and the antenna units 130A, 130B and 130C in the lower part in the vertical direction, the antenna modules 120A, 120B and 120C and the antenna units 130A, 130B and 130C may have a staggered arrangement. For example, the orientations V1, V3 and V5 corresponding to the antenna modules 120A, 120B and 120C are different than the orientations V2, V4 and V6 corresponding the antenna units 130A, 130B and 130C.

Preferably, the antenna units 130A, 130B and 130C and the antenna modules 120A, 120B and 120C could be equiangularly disposed with respect to the central axis L1, which allows each orientation (V1, V2, V3, V4, V5 and V6) form an angle of 60 degrees with adjacent ones. It is understood that the present invention takes three antenna modules and three antenna units as an example, but in practical the number of those antenna components can be increased or decreased according to the requirements.

As mentioned above, the hollow inside part the housing 110, additionally, may include an electronic component 150, such as a camera lens, a microphone module and a speaker, etc. It is noted that the position and the shape of the electronic component 150 shown in FIG. 1A is merely a schematic illustration. In order reduce the interference caused by the signal cable or power cable of the electronic component 150 around the antenna units 130A, 130B and 130C and antenna modules 120A, 120B and 120C, a connecting cable may be disposed in the center of the housing 110 (for example, along with the central axis L1 of the housing 110) or arranged in the way shown in FIG. 1C. FIG.

1C is a top view of the wireless communication device 100 according to an embodiment of the present invention. The electronic component 150 includes a connecting cable 152, which is disposed along with the curved side of the housing 110. In this embodiment, the connecting cable 152 is located on the system ground 140 in the orientation V7. The connecting cable 152 and the antenna units 130A, 130B and 130C are equiangularly disposed with respect to the central axis L1. That is, the links between the central axis L1 and each of the connecting cable 152 and the antenna units 130A, 130B and 130C divides the lower part 114 of the housing 110 into four equal parts; and the orientations V1, V3 and V5 and the orientations V2, V4, V6 and V7 have a staggered arrangement.

Figure 2A:
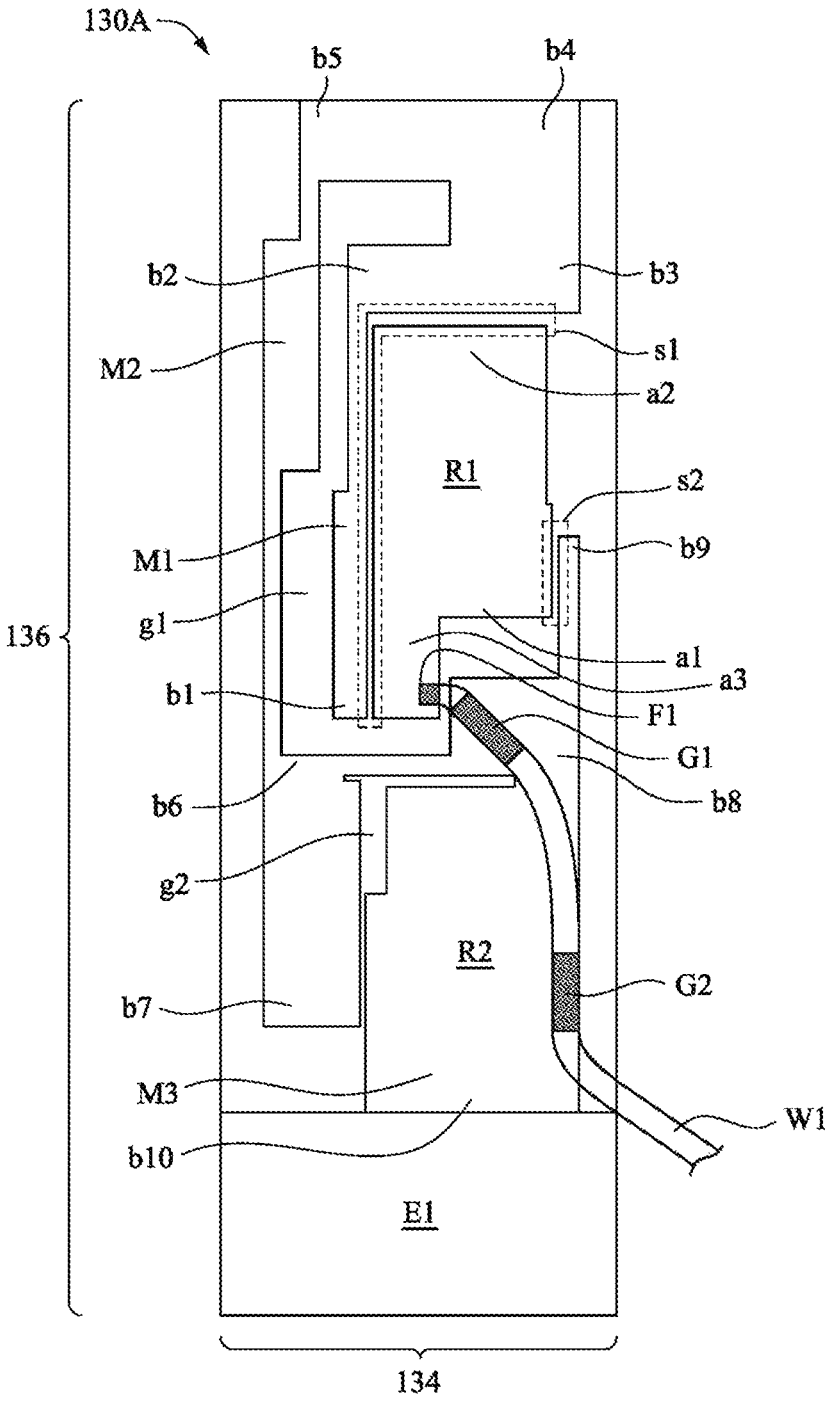
FIGS. 2A~2D are schematic diagrams of antenna units according to embodiments of the present invention.

Please refer to FIG. 2A, which is a schematic diagram of an antenna unit (antenna unit 130A is identical to 130B and 130C) according to an embodiment of the present invention. The antenna unit 130A is, for example, a flexible printed circuit (FPC), having a dimension of 65 mm×20 mm×0.2 mm. In FIG. 2A, the antenna unit 130A includes a radiation part R1, a second radiation part R2 and a conductive component E1. The first radiation part R1 and the second radiation part R2 is, for example, copper material.

The first radiation part R1 has a signal feed point F1 for receiving a feeding signal. In this embodiment, the antenna unit further includes a coaxial cable W1, which has one positive signal terminal and two negative signal terminals. The two negative signal terminals are connected to the system ground 140. The signal feed point F1 is connected to the positive signal terminal of the coaxial cable W1, and the wireless transceiver feeds the feeding signal to the signal feed point F1 of the first radiation part R1 through the positive signal terminal of the coaxial cable W1. The second radiation part R2 surrounds the first radiation part R1 without any contact. The second radiation part R2 has a first side 134, a second side 136, a first ground point G1 and a second ground point G2. The first side 134 is parallel to the system ground 140 while the second side 136 is perpendicular to the system ground 140. Moreover, the first side 134 is perpendicular to the second side 136 and shorter than the second side 136. The conductive component E1 is disposed between the first side 134 and the system ground 140, and coupled to the first side 134 and the system ground 140. The conductive component E1 is conductive material, for example, copper foil. To prevent the coaxial cable W1 from generating unnecessary electrons and interfering antenna's operations, the two negative signal terminals of the coaxial cable W1 are connected to the first ground point G1 and the second ground point G2 individually. It allows the unnecessary electrons generated by the coaxial cable W1 to be transmitted to the system ground 140 through the first ground point G1, the second ground point G2 and the conductive component E1.

In FIG. 2A, the first radiation part R1 consists of areas a1, a2 and a3. One end of the area a1 is connected with the area a2 and the area a1 and the area a2 form a rectangle. The other end of the area a1 is connected with the area a3, where the signal feed point F1 is disposed. As mentioned above, the signal feed point F1 is connected with the positive signal terminal of the coaxial cable W1, and the coaxial cable W1 is connected with the aforementioned wireless transceiver so that the wireless transceiver is capable of transmitting and receiving the feeding signals to/from the signal feed point F1 of the first radiation R1 through the positive signal terminal of the coaxial cable W1.

The second radiation part R2 includes a first metal part M1, a second metal part M2 and the third metal part M3. One end of the first metal part M1 is connected with one end of the second metal part M2. The other end of the second metal part M2 is connected with one end of the third metal part M3. The first ground point G1 is disposed at the second metal part M2, and the second ground point G2 is disposed at the third metal part M3.

To be more specific, the first metal part M1 consists of areas b1, b2, b3 and b4. The areas b1 and b4 are located at two ends of the metal part M1. The first metal part M1 is bent between the areas b1 and b4 to form the areas b2 and b3, and the area b4 is connected with the area b3. The areas b1, b2 and b3 are L-shaped and surround part of the first radiation part R1, but without any contact with the first radiation part R1. The area b1 is near the areas a1 and a3 while the areas b2 and b3 are near the area b2.

The second metal part M2 consists of the areas b5, b6, and b7 and the areas b8 and b9. The area b5 of the second metal part M2 is connected with the area b4 of the first metal part M1. The areas b5 and b9 are located at two ends of the second metal part M2. The area b6 branches out into the areas b7 and b8. The areas b5, b6 and b7 form nearly a line while the areas b6, b8 and b9 form an L shaped. The areas b5 and b6 of the second metal part M2 are parallel to the areas b1 and b2 of the first metal part M1, and the first metal part M1 is between the second metal part M2 and the first radiation part R1. The area b8 is near the area a3 of the first radiation part R1; the area b9 is near the area a1 of the first radiation R1; the areas b8 and b9 surround another part of the first radiation R1, but without any directly contact with the first radiation R1. As seen in FIG. 2A, the second metal part M2 surrounds the first metal part M1 and the first radiation part R1.

The third metal part M3 consists of the area b10. The area b10 of the third metal part M3 branches out of the area b8 of the second metal part M2, opposite the area b9. The area b10 is rectangular and near the area b7, but without any directly contact. As seen in FIG. 2A, the conductive component E1 is located at the first side 134 and coupled to the area b10 of the third metal part M3 of the second radiation part R2.

As mentioned above, the areas b1, b2 and b3 surround a part of the first radiation part R1, and between the first radiation part R1 and the areas b1, b2 and b3 of the first metal part M1 exists a first slot s1, which is L-shaped. The first radiation part R1 and the second radiation part R2 resonate with the first slot s1 to generate a first antenna resonant frequency band and a second antenna resonant frequency band. The first antenna resonant frequency is located, for example, at 704 MHz~960 MHz, and the second antenna resonant frequency is located, for example, at 2300 MHz~2700 MHz.

The area b5 of the second metal part M2 and the areas b3 and b4 of the first metal part M1 form a bend. The areas b1, b2, b3 and b4 of the first metal part M1 and the areas b5 and b6 of the second metal part M2 surround and form a first gap g1. The first gap g1 and the slot s1 are connected, and the area of the first gap g1 is associated with frequency ranges of the first antenna resonant frequency band and the second antenna resonant frequency band. Therefore, the frequency ranges of the first antenna resonant frequency band and the second antenna resonant frequency band can be adjusted by modifying the area, the total length and the total width of the first gap g1. For example, by increasing the area of the first gap g1 near the areas b4 and b5 the frequency ranges of the first antenna resonant frequency band and the second antenna resonant frequency band can be adjusted.

Figure 2B:
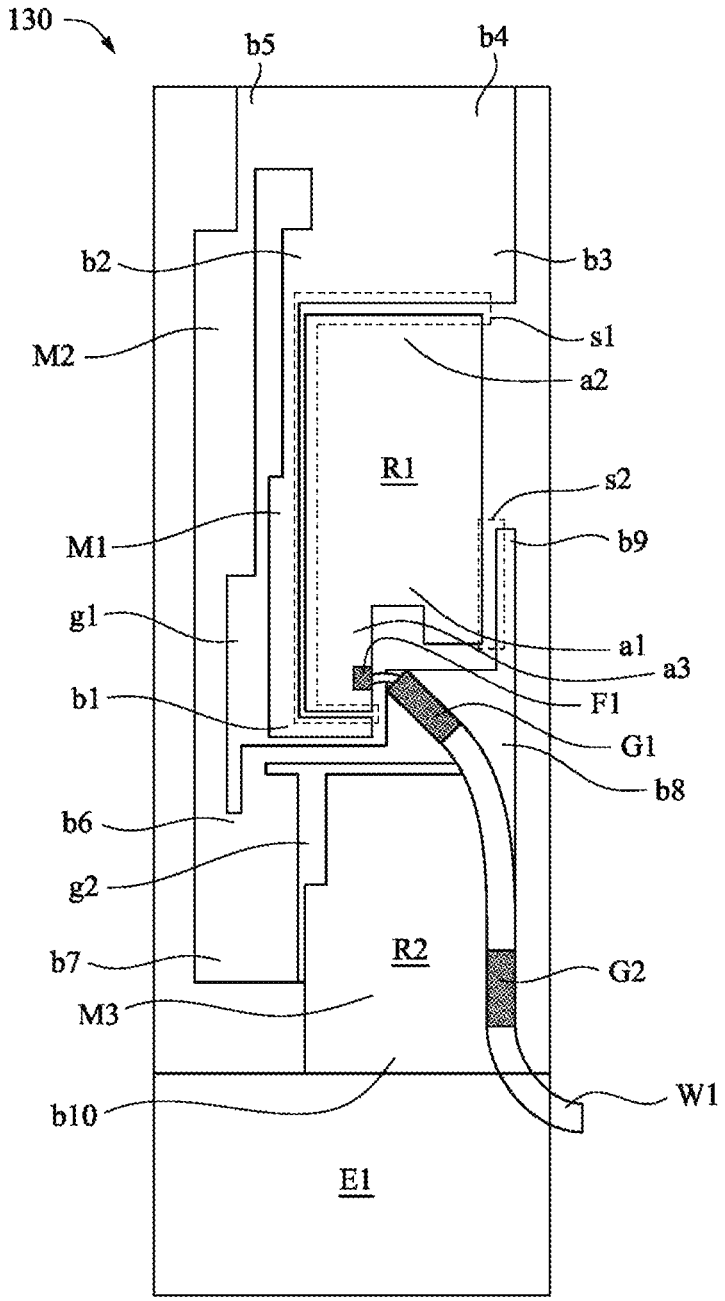

Please refer to FIG. 2B, which is a schematic diagram of an antenna unit according to another embodiment of the present invention. The frequency ranges of the first antenna resonant frequency band and the second antenna resonant frequency band can be adjusted by extending the area b1 of the first metal part M1 and the area a3 surrounding the first radiation part R1 as well.

Between the area b9 of the second metal part M2 and the area a1 of the first radiation part R1 exists a second slot s2, which is connected with the first gap g1. The first radiation part R1 and the second radiation part R2 resonate with the second slot s2 to generate a third antenna resonant frequency band. The third antenna resonant frequency band is located above, for example, 2700 MHz, higher than the first antenna resonant frequency band and the second antenna resonant frequency band.

The third metal part M3 and the second metal part M2 are bent to from a second gap g2, which is L-shaped. To be more specific, the area b8 of the second metal part M2, and the area b10 of the third metal part M3 have a bend. The areas b6, b7 and b8 of the second metal part M2 and the area b10 of the third metal part M3 form the second gap g2. The first radiation part R1 and the second radiation part R2 resonate with the second gap g2 to generate a fourth antenna resonant frequency band, which is located in 1710 MHz~2170 MHz and between the first antenna resonant frequency band the second antenna resonant frequency band.

Figure 2C:
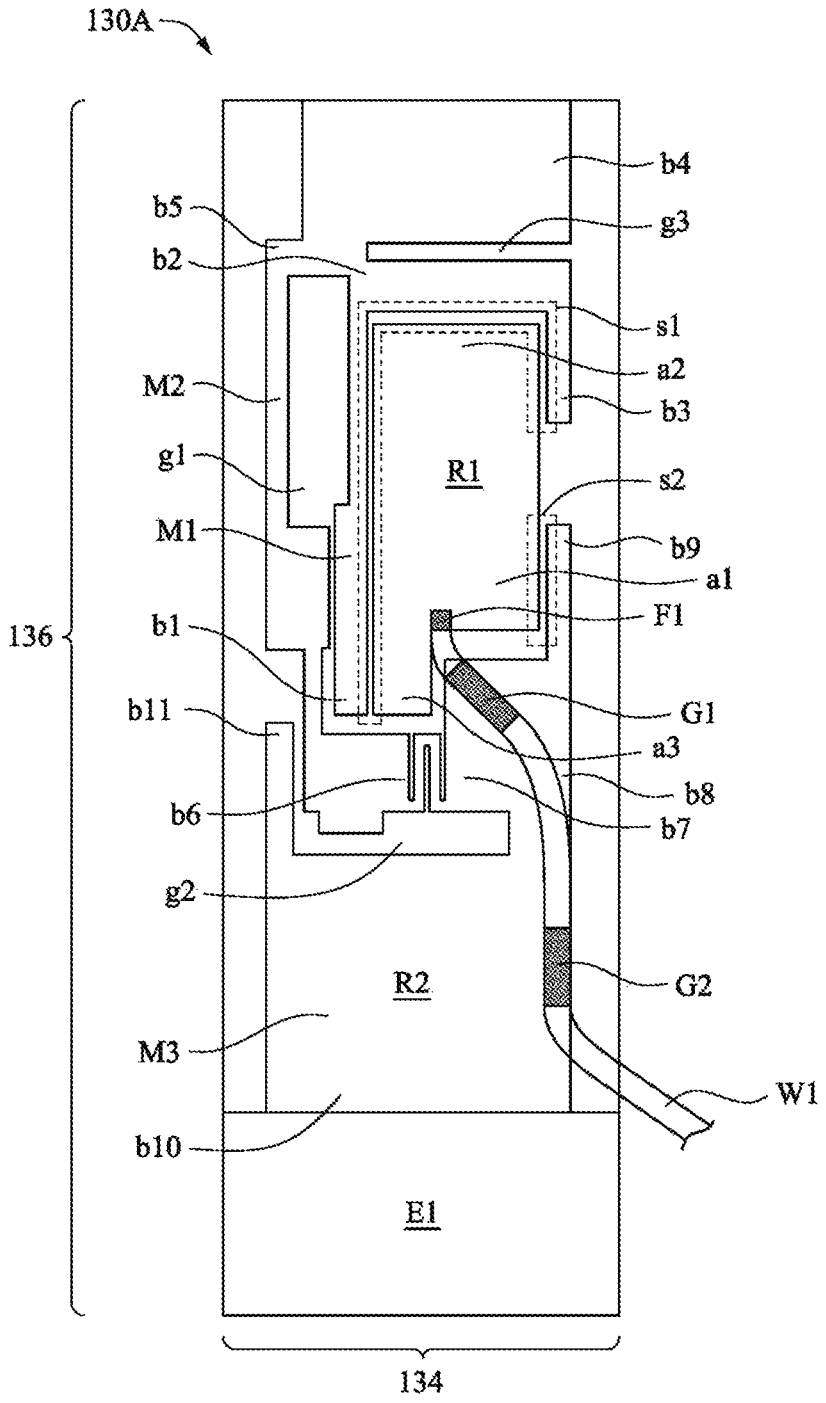

According to another embodiment of the present invention, a schematic diagram of the antenna unit 130A can be as shown in FIG. 2C. In this embodiment, the antenna unit 130A is identical to the antenna units 130B and 130C. In FIG. 2C, the antenna unit 130A is basically the same as the antenna unit 130A shown in FIG. 2A. The following descriptions only elaborate on the differences from the antenna unit 130A in FIG. 2A. In this embodiment, the first radiation part R1 has a signal feed point F1 at the area a1, and the second radiation part R2 surrounds the first radiation part R1 without any contact. The areas b1, b2 and b3 form a U shape and surround a part of the first radiation part R1 without a contact with the first radiation part R1. The area b1 is near the areas a1 and a3; the areas b2 and b3 are near the area a2. There exists a third gap g3 among the areas b2, b3 and b4, which form a U shape.

The second metal part M2 consists of the areas b5~b9 and the area b5 of the second metal part M2 is connected with the area b4 of the first metal part M1. The areas b5 and b9 are located at two ends of the second metal part M2. The areas b5, b6, b7. B8 and b9 of the second metal part M2 form a U shape; the areas b6 and b7 have a bend in between. In addition, the area b5 is parallel to the areas b1 and b2 of the first metal part M1 without a contact, and the first metal part M1 is located between the first radiation part R1 and the second metal part M2. The areas b6, b7 and b8 of the second metal part M2 is near the area a3 of the first radiation part R1; the area b9 is near the area a1 of the first radiation part R1. The areas b6~b9 surround another part of the first radiation part R1 without any contact with the first radiation part R1. As seen in FIG. 2C, the second metal part M2 surrounds the first metal part M1 and the first radiation part R1.

The third metal part M3 consists of the areas b10 and b11, and the area b10 of the third metal part M3 is extended, opposite the area b9, from the area b8 of the second metal part M2. The areas b10 and b11 is located at two ends of the third metal part M3. One end of the area b10 is connected to the area b8 while the other end of the area b10 is connected to the area b11. The area b11 is near the area b5 but without a contact with the area b5. The third metal part M3 is connected with the second metal part M2 at the area b8. The first side 134 of conductive element E1 is coupled to the area b10 of the third metal part M3 of the second radiation part R2.

As mentioned above, the areas b1, b2 and b3 surround a part of the first radiation part R1, and among the areas b1, b2 and b3 of the first metal part R1 exists the first slot s1, which is U-shaped. The first radiation part R1 and the second radiation part R2 resonate with the first slot s1 to generate the first antenna resonant frequency band and the second antenna resonant frequency band. The first antenna resonant frequency band is located in, for example, 704 MHz~960 MHz, and the second antenna resonant frequency is located in, for example, 2300 MHz~2700 MHz.

Compared to the embodiments regarding FIG. 2A, the area b3 of the second metal part M2 in FIG. 2C is extended to surround a side of the first radiation part R1, which is opposite the side surrounded by the area b1, for the adjustment of the first antenna resonant frequency band and the second antenna resonant frequency band. Moreover, there are continuous bends between the areas b6 and b7. By increasing the total path length of the second metal part M2, the ranges of the first antenna resonant frequency band and the second antenna resonant frequency band can be adjusted as well. Furthermore, the third gap g3 formed around the areas b2, b3 and b4 can also be used to adjust the ranges of the first antenna resonant frequency band and the second antenna resonant frequency band.

Figure 2D:
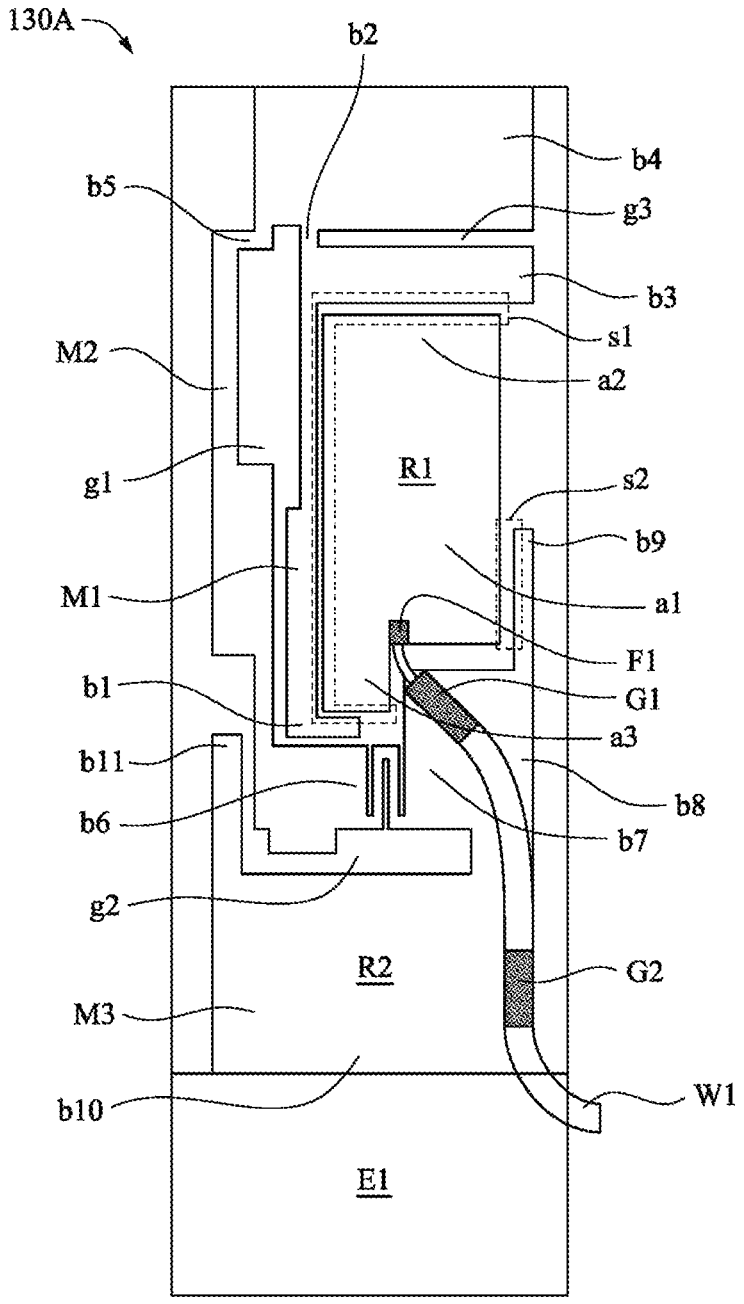

The areas b2 and b4 of the first metal part M1 and the area b5 of the second metal part M2 form bends. The areas b1, b2 and b4 of the first metal part M1 and the areas b5 and b6 of the second metal part M2 form the first gap g1. The first gap g1 is connected with the first slot s1, and the area of the first gap g1 is associated with the ranges of the first antenna resonant frequency band and the second antenna resonant frequency band. Therefore, by modifying the area, the total length or the width of the first gap g1 the frequency ranges of the first antenna resonant frequency band and the second antenna resonant frequency band can be adjusted. For example, by extending the length of the area b3 surrounding the first radiation part R1 (as shown in FIG. 2C) of the first metal part M1; or/and extending the area b1 of the first metal part M1 to surround the area a3 of the first radiation part R1 (as shown in FIG. 2D); or/and extending the first gap g1 towards the area b4 to change the area of the first gap g1 (as shown in FIG. 2D), the ranges of the first antenna frequency band and the second antenna frequency band can be further adjusted. Although there are some differences between the antenna patterns in FIG. 2C and FIG. 2D according to the embodiments, both can achieve a similar antenna resonant effect.

The area b9 of the second metal part M2 and the first radiation R1 form a second slot s2, which is connected with the first gap g1. The first radiation R1 and the second radiation R2 resonate with the second slot s2 to generate the third antenna resonant frequency band. The third antenna resonant frequency band is above 2700 MHz.

The third metal part M3 and the second metal part M2 are bent to form a second gap g2, which is L-shaped. To be more specific, the second gap g2 is formed and surrounded by the areas b6, b7 and b8 of the second metal part M2 and the areas b10 and b11 of the third metal part M3. The bend of the second gap g2 is between the areas b7 and b9 of the second metal part M2 and the area b10 of the third metal part M3. The first radiation part R1 and the second radiation part R2 resonate with the second gap g2 to generate the forth antenna resonant frequency band, which is located in 1710 MHz~2170 MHz as well as between the first antenna resonant frequency band and the second antenna resonant frequency band.

According to the embodiments regarding FIGS. 2A~2D, the antenna units 130A, 130B and 13C can modify the area, length and width of each area by simple ways, such as increasing the third gap g3, extending the first slot s1, and extending the first gap g1, to adjust parameters related to the antenna resonant frequency bands.

Figure 3A:
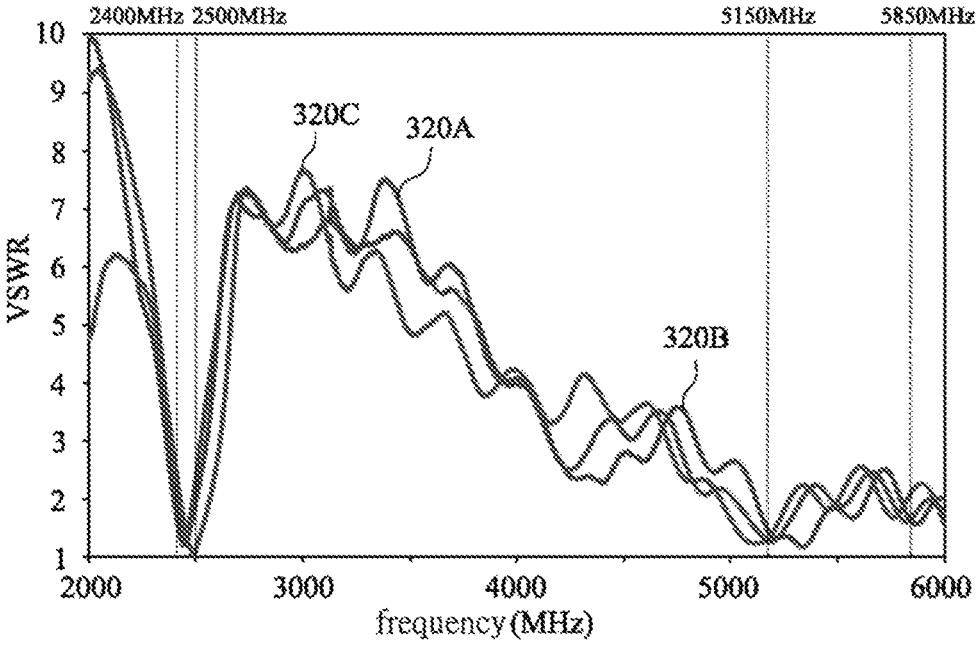
FIGS. 3A~3B are plots of VSWR vs. frequency for a wireless communication device according to an embodiment of the present invention.
Figure 3B:
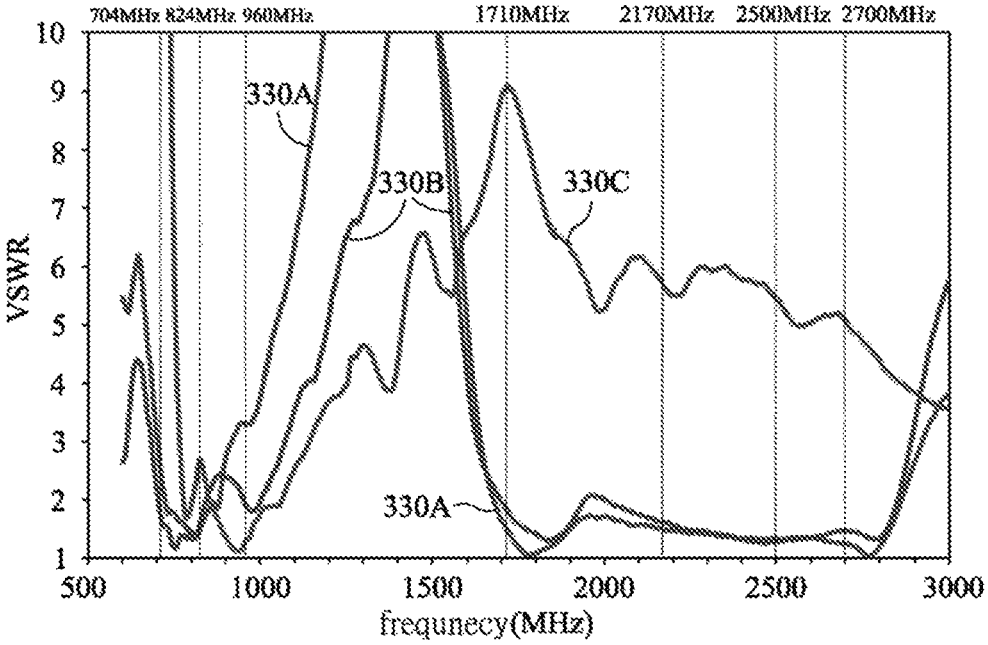

FIGS. 3A~3B show plots of VSWR vs. frequency for a wireless communication device 100 according to an embodiment of the present invention. FIG. 3A shows the plot of VSWR vs. frequency for the antenna modules 120A, 120B and 120C when the antenna modules 120A, 120B and 120C and the antenna units 130A, 130B and 130C are all disposed on the housing 110 of the wireless communication device 100. FIG. 3B shows the plot of VSWR vs. frequency for the antenna units 130A, 130B and 130C when the antenna modules 120A, 120B and 120C and the antenna units 130A, 130B and 130C are all disposed on the housing 110 of the wireless communication device 100. In FIGS. 3A and 3B, the Y-axis represents VSWR; the X-axis represents frequency in MHz.

Figure 4A:
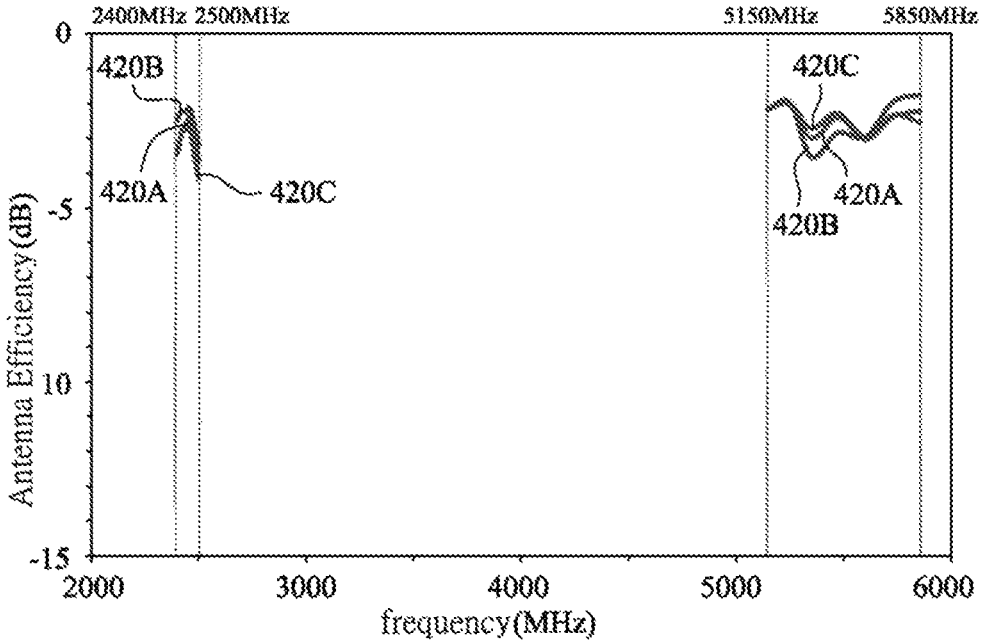
FIGS. 4A~4B are plots of antenna efficiency vs. frequency for a wireless communication device according to an embodiment of the present invention.
Figure 4B:
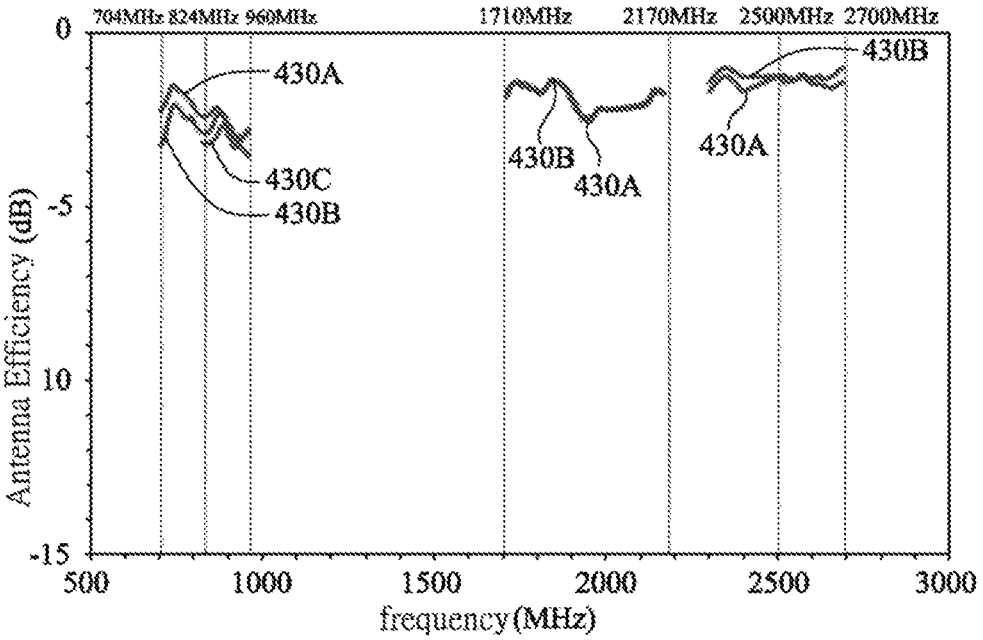

FIGS. 4A~4B show plots of antenna efficiency vs. frequency for the wireless communication device 100 according to an embodiment of the present invention. FIG. 4A shows the plot of antenna efficiency vs. frequency for the antenna modules 120A, 120B and 120C when the antenna modules 120A, 120B and 120C and the antenna units 130A, 130B and 130C are all disposed on the housing 110 of the wireless communication device 100. FIG. 4B shows the plot of antenna efficiency vs. frequency for the antenna units 130A, 130B and 130C when the antenna modules 120A, 120B and 120C and the antenna units 130A, 130B and 130C are all disposed on the housing 110 of the wireless communication device 100. FIG. In FIGS. 4A and 4B, the Y-axis represents antenna efficiency in dB; the X-axis represents frequency in MHz.

In FIG. 3A, a curve 320A represents VSWR vs. frequency for the antenna module 120A (primary Wi-Fi antenna); a curve 320B represents VSWR vs. frequency for the antenna module 120B (auxiliary Wi-Fi antenna); a curve 320C represents VSWR vs. frequency for the antenna module 120C (ZigBee antenna). As seen, the VSWR of the antenna modules 120A, 120B and 120C approximates to 1 in the 2.4G frequency band (about 2400 MHz~2500 MHz) and 5G frequency band (about 5150 MHz~5850 MHz), showing excellent antenna impedance matching.

In FIG. 4A, a curve 420A represents antenna efficiency vs. frequency for the antenna module 120A (primary Wi-Fi antenna); a curve 420B represents antenna efficiency vs. frequency for the antenna module 120B (auxiliary Wi-Fi antenna); a curve 420C represents antenna efficiency vs. frequency for the antenna module 120C (ZigBee antenna). As seen, the antenna efficiency of the antenna modules 120A, 120B and 120C ranges −2.1~-4.2 dB in 2.4G frequency band and −1.8~-3.5 dB in 5G frequency band. The abovementioned values of the antenna efficiency are all above −5 dB, showing an excellent antenna efficiency.

In FIG. 3B, a curve 330A represents VSWR vs. frequency for the antenna unit 130 A (primary LTE antenna); a curve 330B represents VSWR vs. frequency for the antenna unit 130B (auxiliary LTE antenna); a curve 330C represents VSWR vs. frequency for the antenna unit 130C (Z-wave antenna). As seen, the VSWR of the antenna units 130A, 130B and 130C approximates to 1 in the LTE frequency band (about 704 MHz~960 MHz, 1710 MHz~2170 MHz, 2300 MHz~2700 MHz) and in the Z-wave frequency band (about 868 MHz and 908 MHz), showing excellent antenna impedance matching.

In FIG. 4B, a curve 430A represents antenna efficiency vs. frequency for the antenna unit 130 A (primary LTE antenna); a curve 430B represents antenna efficiency vs. frequency for the antenna unit 130B (auxiliary LTE antenna); a curve 430C represents antenna efficiency vs. frequency for the antenna unit 130C (Z-wave antenna). As seen, the antenna efficiency of the antenna units 130A, 130B and 130C ranges from −1.5 dB to −3.5 dB in a low frequency band (about 704 MHz~960 MHz) and from −1.3 dB to −2.6 dB in an intermediate frequency band (1710 MHz−2170 MHz), and from −1.0 to −1.7 dB in a high frequency band (2300 MHz−2700 MHz). The abovementioned values of the antenna efficiency are all above −5 dB, showing excellent antenna impedance matching.

Table 1 below shows isolation between one and another among the antenna modules 120A~120C and the antenna units 130A~130C. The isolation is defined as a ratio between the power loss from one antenna module/antenna unit to another antenna module/antenna unit and the original input power, expressed in term of dB.

TABLE 1

| Isolation (dB) | 130A | 130B | 120A (2.4 GHz) | 120B (2.4 GHz) | 120A (5 GHz) | 120B (5 GHz) |
|---|---|---|---|---|---|---|
| 130A | — | — | — | — | — | — |
| 130B | −13.2 | — | — | — | — | — |
| 130C | −11.6 | −10.5 | — | — | — | — |
| 120A | −20.6 | −30.4 | — | — | — | — |
| 120B | −22.75 | −28.75 | −22.4 | — | −26.18 | — |
| 120C | −24.1 | −28.7 | −27.4 | −32.1 | −30.89 | −36.3 |

As known from Table 1, the isolation between one and another among the antenna modules 120A~120C and the antenna units 130A~130C has all the values below −10 dB in the low frequency band and below −15 dB in the high frequency band, which shows excellent isolation.

Table 2 and Table 3 below show envelop correlation coefficients (ECCs) between one and another among the antenna modules 120A, 120B and 120C.

TABLE 2

| ECC | 120A (Wi-Fi 2.4G) | 120B (Wi-Fi 2.4G) |
|---|---|---|
| 120A (Wi-Fi 2.4G) | — | — |
| 120B (Wi-Fi 2.4G) | <0.1 | — |
| 120C (ZigBee) | <0.1 | <0.1 |

TABLE 3

| ECC | 120A (Wi-Fi 5G) | 120B (Wi-Fi 5G) |
|---|---|---|
| 120A (Wi-Fi 5G) | — | — |
| 120B (Wi-Fi 5G) | <0.1 | — |
| 120C (ZigBee) | <0.1 | <0.1 |

Table 4 below shows ECCs between one and another among the antenna units 130A, 130B and 130C.

TABLE 4

| ECC | 130A (LTE) | 130C (Z-wave) |
|---|---|---|
| 130A (LTE) | — | — |
| 130C (Z-Wave) | <0.1 | — |
| 130B (LTE) | 0.15 | <0.1 |

As known from the Table 2, Table 3 and Table 4, the ECCs between one and another among the antenna modules 120A~120C and the antenna units 130A~130C of the wireless communication device 100 are all less than 0.1, except for low frequency band.

Although the present invention has been described in the considerable details with reference to the certain preferred embodiments thereof, the scope of the invention is not limited to the disclosure. Persons having ordinary skill in the art may make various modifications and changes without departing from the scope and spirit of the invention. Therefore, the scope of the present invention shall be as defined in the appended claims.

What is claimed is:

1. A wireless communication device comprising:

a housing comprising a system ground; and a plurality of antenna units, surrounding a surface of the housing and standing on the system ground, each of the antenna units comprising:

a first radiation part, having a signal feed point for receiving a feeding signal;

a second radiation part, surrounding the first radiation part, the second radiation part having a first side, a second side, a first ground point and a second ground point, wherein the first side is parallel to the system ground, the second side is perpendicular to the system ground, and the first side is perpendicular to the second side and shorter than the second side, and the first ground point and the second ground point are individually connected to the system ground; and a conductive component disposed between the first side and the system ground and connected to the first side and the system ground.

2. The wireless communication device according to claim 1, wherein the second radiation part comprises a first metal part and a second metal part; the first metal part is located between the first radiation part and the second metal part; the first metal part and the first radiation part have a first slot in between; one end of the first metal part is connected to one end of the second metal part; the second metal part and the first metal part are bent to form a first gap, and the first slot and the first gap are connected.

3. The wireless communication device according to claim 2, wherein the first radiation part and the second radiation part resonate with the first slot to generate a first antenna resonant frequency band and a second antenna resonant frequency band, and the first antenna resonant frequency band is lower than the second antenna resonant frequency band.

4. The wireless communication device according to claim 3, wherein a dimension of the first gap is associated with frequency ranges of the first antenna resonant frequency band and the second antenna resonant frequency band.

5. The wireless communication device according to claim 3, wherein the second metal part surrounds the first metal part and the first radiation part; the second metal part and the first radiation part have a second slot in between, and the second slot and the first gap are connected; the first radiation part and the second radiation part resonate with the second slot to generate a third antenna resonant frequency band; the third antenna resonant frequency band is higher than the first antenna resonant frequency band and the second antenna resonant frequency band.

6. The wireless communication device according to claim 3, wherein the second radiation part further comprises a third metal part, and the third metal part is located between the second metal part and the conductive component, wherein one end of the third metal part is connected to the other end of the second metal part, the other end of the third metal part is connected to the conductive component, and the second metal part and the third metal part are bent to form a second gap; the first radiation part and the second radiation part resonate with the second gap to generate a forth antenna resonant frequency band, and the forth antenna resonant frequency band is between the first antenna resonant frequency band and the second antenna resonant frequency band.

7. The wireless communication device according to claim 6, the first ground point is disposed on the second metal part while the second ground point is disposed on the third metal part.

8. The wireless communication device according to claim 3, wherein the second metal part further comprises a third gap for adjusting a frequency range of the first antenna resonant frequency band.

9. The wireless communication device according to claim 1 further comprising a plurality of antenna modules, and the hosing further comprising an upper part and a lower part, wherein the antenna units are disposed around a surface of the lower part, and the antenna modules are disposed around a surface of the upper part, and links between each of the antenna modules and a central axis of the hosing have different orientations from links between each of the antenna units and the central axis of the hosing.

10. An antenna unit, standing on a system ground of a wireless communication device, the antenna unit comprising:

a first radiation part having a signal feed point for receiving a feeding signal;

a second radiation part surrounding the first radiation part, the second radiation part having a first side, a second side, a first ground point and a second ground point, wherein the first side is parallel to the system ground, the second side is perpendicular to the system ground, and the first side is perpendicular to the second side and shorter than the second side, and the first ground point and the second ground point are individually connected to the system ground; and a conductive component disposed between the first side and the system ground and connected to the first side and the system ground.

11. The antenna unit according to claim 10, wherein the second radiation part comprises a first metal part and a second metal part; the first metal part is located between the first radiation part and the second metal part; the first metal part and the first radiation part have a first slot in between; one end of the first metal part is connected to one end of the second metal part; the second metal part and the first metal part are bent to form a first gap, and the first slot and the first gap are connected.

12. The antenna unit according to claim 11, wherein the first radiation part and the second radiation part resonate with the first slot to generate a first antenna resonant frequency band and a second antenna resonant frequency band, and the first antenna resonant frequency band is lower than the second antenna resonant frequency band.

13. The antenna unit according to claim 12, wherein a dimension of the first gap is associated with the first antenna resonant frequency band and the second antenna resonant frequency band.

14. The antenna unit according to claim 12, wherein the second metal part surrounds the first metal part and the first radiation part; the second metal part and the first radiation part have a second slot in between, and the second slot and the first gap are connected; the first radiation part and the second radiation part resonate with the second slot to generate a third antenna resonant frequency band; the third antenna resonant frequency band is higher than the first antenna resonant frequency band and the second antenna resonant frequency band.

15. The antenna unit according to claim 12, wherein the second radiation part further comprises a third metal part, and the third metal part is located between the second metal part and the conductive component, wherein one end of the third metal part is connected to the other end of the second metal part, the other end of the third metal part is connected to the conductive component, and the second metal part and the third metal part are bent to form a second gap; the first radiation part and the second radiation part resonate with the second gap to generate a forth antenna resonant frequency band; the forth antenna resonant frequency band is between the first antenna resonant frequency band and the second antenna resonant frequency band.

16. The antenna unit according to 15, wherein the first ground point is disposed on the second metal part while the second ground point is disposed on the third metal part.

17. The antenna unit according to 12, wherein the second metal part further comprises a third gap for adjusting a frequency range of the first antenna resonant frequency band.

* * * * *